US005309066A

United States Patent [19]

Ditlevsen

[11] Patent Number: 5,309,066

[45] Date of Patent: May 3, 1994

[54] SOLID STATE BALLAST FOR FLUORESCENT LAMPS

[75] Inventor: Claes Ditlevsen, Silkeborg, Denmark

[73] Assignee: Jorck & Larsen A/S, Them, Denmark

[21] Appl. No.: 887,788

[22] Filed: May 29, 1992

[51] Int. Cl.[5] ..... H05B 37/00

[52] U.S. Cl. ..... 315/205; 315/209 R; 315/DIG. 2; 315/DIG. 5; 315/DIG. 7; 363/132; 363/22

[58] Field of Search ..... 315/205, 307, DIG. 2, 315/DIG. 5, DIG. 7, 209 R; 363/132, 22

[56] References Cited

U.S. PATENT DOCUMENTS 3,590,362 6/1971 Kakalec .
4,398,128 8/1983 Wollank .
4,463,285 7/1984 Nilssen ..... 315/205
4,506,318 3/1985 Nilssen .
4,513,364 4/1985 Nilssen .
4,692,681 9/1987 Nilssen .
4,745,537 5/1988 Cheung .
4,935,862 6/1990 Herbsleb et al. ..... 315/205
5,047,690 9/1991 Nilssen ..... 315/205
5,063,331 11/1991 Nostwick ..... 315/307

*Primary Examiner*—Robert J. Pascal
*Assistant Examiner*—Haissa Philogene
*Attorney, Agent, or Firm*—Poms, Smith, Lande & Rose

[57] ABSTRACT

A device to produce alternating electric current of high frequency for power consumers such as fluorescent lamps, which includes the means of supplying a DC voltage nearly twice the size of the peak voltage of the alternating voltage input—with negligible loss of power—to the remainder of the circuit and thus reducing the intrinsic power consumption of the device as well as making it possible to supply the said power consumer such as the fluorescent lamp with a higher start voltage as well as a higher voltage in operation.

12 Claims, 3 Drawing Sheets

SOLID STATE BALLAST FOR FLUORESCENT LAMPS

FIELD OF THE INVENTION

The present invention relates generally to ballasts for driving fluorescent or gas discharge lamps.

BACKGROUND OF THE INVENTION

Fluorescent lamps have become widely used in the past several years due to their relatively low power consumption and high light output, especially as compared with incandescent type lamps. With the general expansion in the use of fluorescent lamps, fluorescent lamps have found their way into a wide variety of applications, including high and low temperature environments. Fluorescent lamps have also become the dominant lighting fixture for offices, factories and other businesses.

Solid state ballasts which drive fluorescent lamps are similar to the prior art shown in FIG. 1 of the attached drawings, which is similar to the ballast shown in U.S. Pat. No. 4,935,862. Ballasts frequently consist of a rectifier to convert an incoming alternating current (AC) signal to a high voltage direct current (DC) signal which is then used to drive the fluorescent lamps. A full wave rectifier, as shown in FIG. 1, is fairly common, as is a half-wave rectifier (not shown). A pulsed DC voltage that is output by this AC to DC converter is applied across a fluorescent lamp in order to excite the gas contained within the fluorescent lamp, which causes the lamp to light. A feedback circuit is generally associated with the fluorescent lamp, causing the DC signal to pulse, and the voltage across the fluorescent lamp to oscillate. A starter circuit is usually provided to supply a start pulse to begin the oscillation of the DC voltage.

The voltage applied across a fluorescent lamp must be sufficient to excite the atoms and generate light. Typically, a voltage level of approximately 110–130 volts is sufficient to cause a five foot long T8 fluorescent lamp to light. When operating in a low temperature environment, however, the voltage which must be applied across the fluorescent must be higher because the low temperature of the gas, and resulting decreased entropy of the atoms requires a higher energy in order for the atoms to become excited enough to generate light. The impedance of a fluorescent lamp at a given temperature remains fixed and the higher energy can only be supplied in the form of a higher voltage across the electrodes in the fluorescent lamps.

Another problem which compounds the low temperature ignition difficulties of a fluorescent lamp is parasitic resistances which may develop between the fluorescent lamp and ballast driving the fluorescent lamp. These parasitic resistances can take the form of deterioration of the wires going to the ballast causing an increased resistance and the like. In addition, certain types of fluorescent lamp ballasts use components which are temperature sensitive. Significant changes in the operating temperature of the ballast requires the circuit to be redesigned, or retuned to accommodate the changed circumstances.

Another disadvantage of fluorescent tubes is a stroboscopic effect or flickering. Using classic ballasts in which the incoming 50 or 60 Hz AC signal is routed directly to the fluorescent lamp, the luminous arch is ignited and turned off with a frequency of double the supply frequency, i.e. 100 or 120 Hertz. This stroboscopic effect is usually not visible, but may under adverse circumstances especially at cooler temperatures cause inconvenience. Furthermore, acoustic noise is often induced, particularly by the induction coil, and the usual simple ignition device may cause slow ignition involving several attempts to ignite the lamp accompanied by an unpleasant flicker.

These problems frequently go unnoticed because the user of a fluorescent lamp and ballast will frequently change the fluorescent lamp when a problem develops. Changing the fluorescent lamp involves releasing electrical connectors which are attached to the fluorescent lamp and reconnecting the connectors to a new fluorescent lamp that has no corrosion on the connectors and has not yet suffered any degradation of the electrode elements within the lamp itself. This results in replacing fluorescent lamps much more frequently than is necessary, and in discarding fluorescent lamps which would be usable in a room temperature application or would be usable with a better ballast. This results in the production of a large amount of waste.

If replacing the fluorescent lamp with a new lamp does not solve the particular problem, the entire ballast is replaced, usually at a much greater cost than replacing the lamp. This may solve the problem temporarily or may result in successive replacement of the ballast and lamp until an optimum match is achieved between a particular ballast and lamp which produces results acceptable to the user.

SUMMARY OF THE INVENTION

It is, therefore, an object of the present invention to provide a ballast which can provide sufficient voltage to cause a fluorescent lamp to generate acceptable light output when the lamp is placed in a low temperature environment (such as between −26° C. and +70° C.

It is a further object of the present invention to provide a high frequency electric current for power consuming devices such as fluorescent tubes.

It is a further object of the present invention to provide an electronic ballast which reduces the power consumption of the fluorescent ballast and fluorescent lamp without reducing the light output by the fluorescent lamp.

It is a further object of the present invention to provide an electronic ballast that increases the light output by an attached fluorescent lamp in colder ambient temperatures, particularly temperatures less than 7° C.

It is a further object of the present invention to provide a ballast for a fluorescent lamp which maintains a high voltage which does not decrease significantly between cycles of an alternating current supply to decrease the voltage across a fluorescent lamp by an amount large enough to produce a change in the light output of the fluorescent lamp which is visible to a human eye.

The present invention replaces the full-wave or half-wave rectifier bridge of the prior art with a voltage doubler, and tunes the components of an oscillator circuit to apply a greater voltage across a fluorescent lamp to cause it to start in low temperature environments. This results in a voltage being applied across the fluorescent lamp which exceeds the voltage necessary to cause the lamp to light at room temperature, but operates the tube more optimally at lower temperatures. The DC voltage decreases slightly between alternating peaks of the incoming AC signal, but at no time allows the voltage to drop to a point where the available voltage is less than that required to completely illuminate the fluorescent lamp.

DETAILED DESCRIPTION OF A PREFERRED EMBODIMENT

Figure 4:
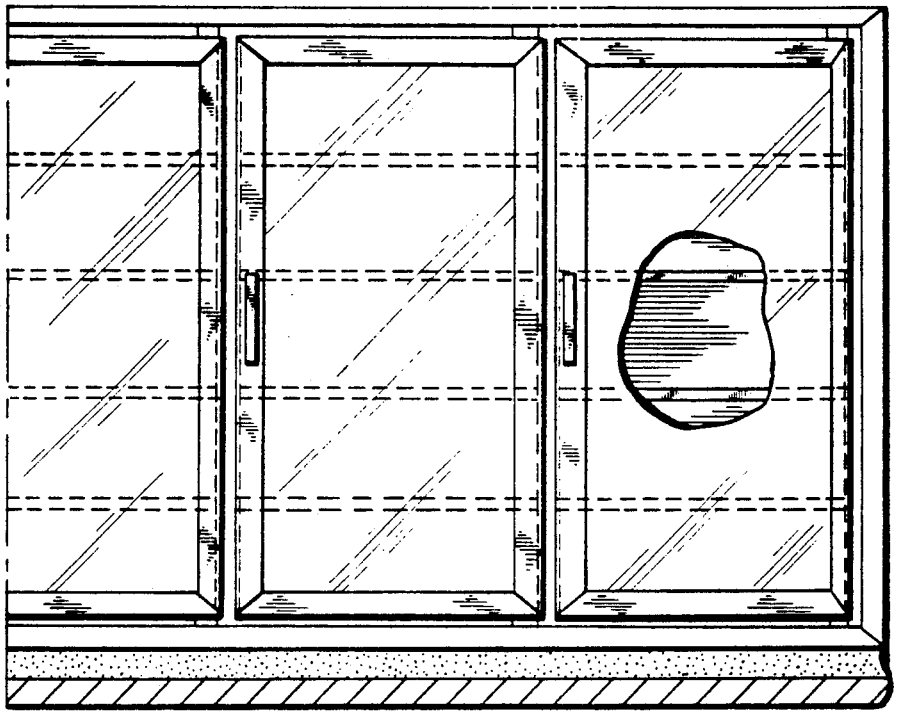
FIG. 4 is an elevation view of a freezer display case having doors mounted thereon and shelves mounted inside the case.
Figure 5:
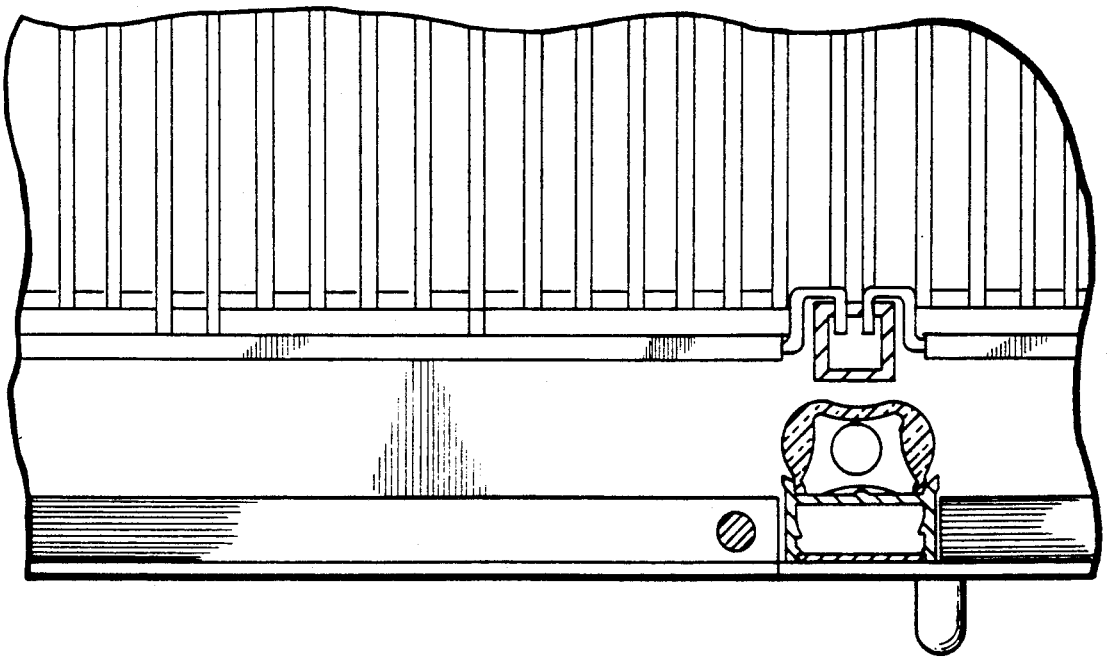
FIG. 5 is a side view of the inside of the freezer of FIG. 4.

Referring to FIGS. 4 and 5, a commercial refrigeration unit maintains the temperature of commercial goods to be sold at a temperature below the freezing point of the goods, such as ice cream, frozen foods, and the like. Typically, the temperature is maintained significantly below the freezing point of these goods in order to allow for a frequent opening and closing of the refrigerator doors by a shopper without raising the temperature of the goods contained in the freezer above their melting point. This prevents spoilage and freezer burn which may effect the goods contained in the freezer if they are allowed to defrost and refreeze frequently.

Figure 2:
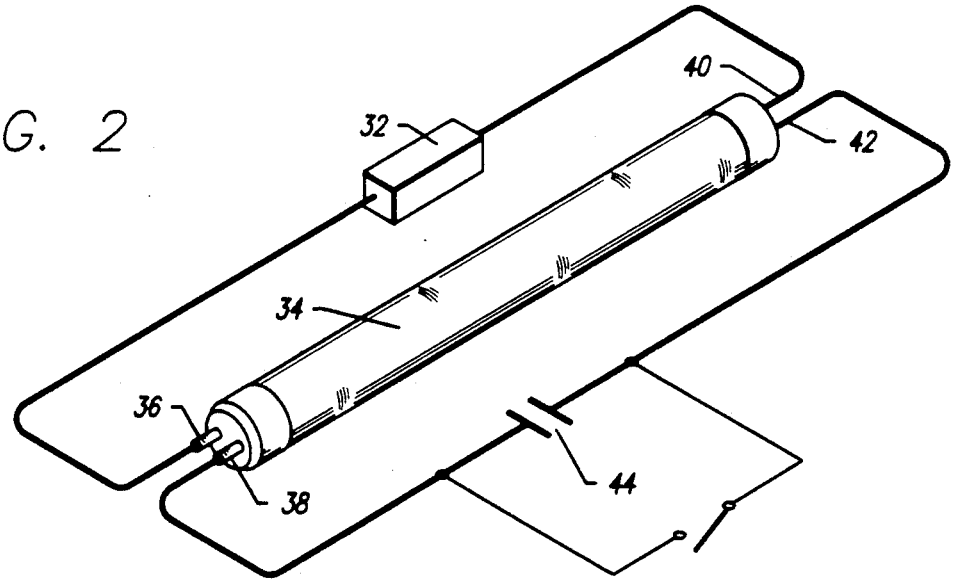
FIGS. 2 is a diagram of a fluorescent lamp interconnected to a ballast.

In order to light the goods located in the freezer and make them visible to the consumer, a fluorescent lamp, as shown in FIG. 2, is installed in several locations within the freezer of FIGS. 4 and 5. Locating the fluorescent lamps inside the freezer forces the fluorescent lamp to operate in a low temperature environment which affects the performance of the fluorescent lamp by requiring an increased voltage level to start and maintain operation of the fluorescent lamp. The low temperature environment will also affect the ballast if the ballast itself is located within the refrigerated area.

Figure 1:
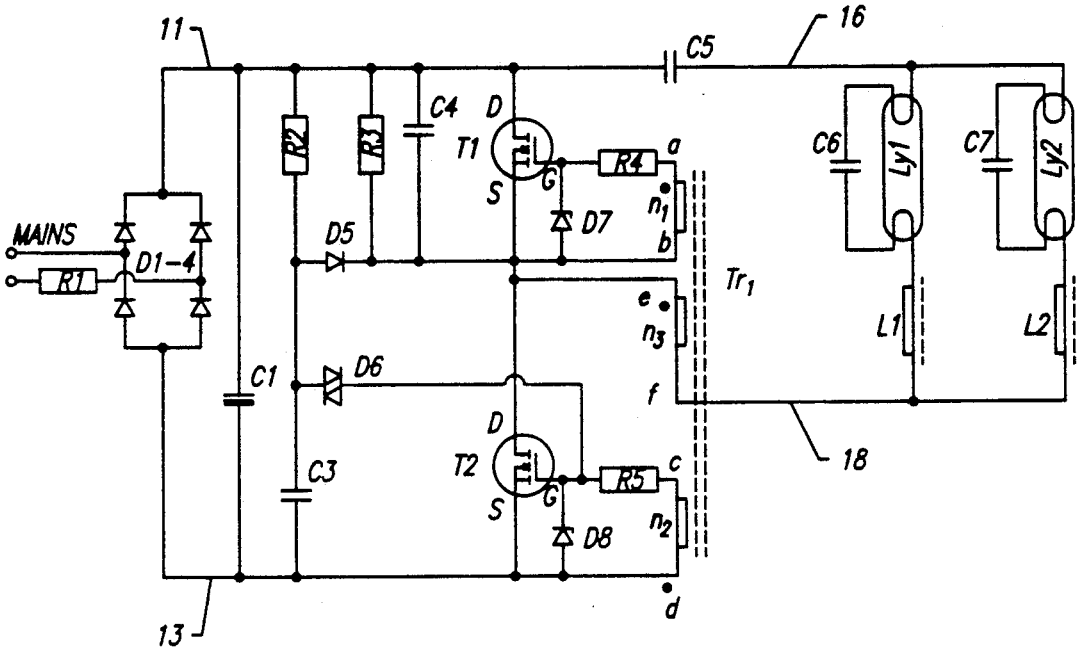
FIG. 1 PRIOR ART
FIG. 1 is a schematic circuit diagram of the prior art.

Referring to FIG. 1, the prior art ballasts generally employ a full-wave rectifier, D1-4, or a half-wave rectifier (not shown) to create a pulsed DC voltage across lines 10 and 13. This pulsed DC voltage is smoothed by capacitor C1. The DC voltage is then applied to fluorescent lamps LY1 and LY2. Transformer TR1 selectively activates switch T1 and T2 to change the voltage at line 16 on one side of the fluorescent lamps. This causes the voltage across the fluorescent lamps to oscillate.

The present invention is particularly applicable to electronic ballasts which are connected to a 100–120 volt AC power supply line operating at 50 or 60 hertz. In order to maximize the stability and longevity of the component parts of the ballast of the present invention, it is desirable to minimize power consumption/power loss which occurs within the ballast circuit. By reducing the power consumption/loss within the ballast, the heat generated by the ballast circuit is reduced, thereby reducing the intrinsic operating temperature of the ballast. Since the ballast will operate for extended periods of time, preventing the temperature of the ballast from being elevated, reduces the stress on the component parts of the ballast, and has the effect of prolonging usable lifetime.

In comparison with the prior art of FIG. 1, the present invention provides a reduced load and reduced power loss in the individual components of the ballast because of the higher DC input voltage. The prior art device of FIG. 1 would require a large transformer in order to supply an average voltage output of 300 volts DC. By employing the voltage doubler circuit which increases the input DC voltage to a level greater than the DC voltage of the prior art device with an input of 120 volts AC, the power dissipation in the circuitry of the electronic ballast also reduced, and the DC voltage increased to approximately 300 volts.

Figure 3:
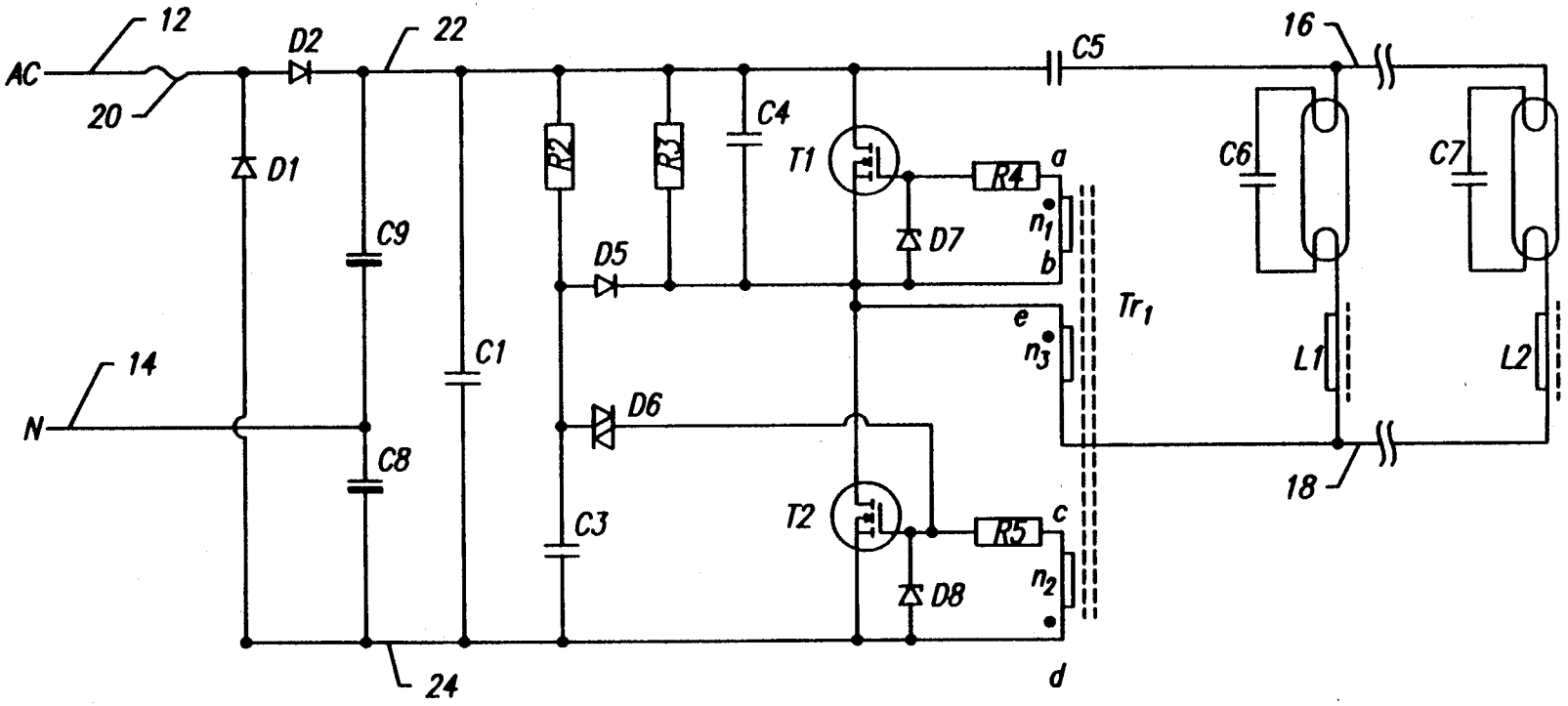
FIG. 3 is a schematic circuit diagram of one implementation of the present invention.

Referring now to FIG. 3, diodes D1 and D2 and capacitors C8 and C9 form a voltage doubler circuit which rectifies the incoming AC signal to form a pulsed DC signal at a voltage substantially greater than the pulsed DC voltage across lines 16 and 18 in FIG. 1.

The diodes ensure that the electrolytic capacitors are loaded by the appropriate phase of the incoming AC supply voltage. The electrolytic capacitors are coupled in series in order to add the voltages stored in each of the electrolytic capacitors to produce the DC input voltage which drives the remainder of the ballast circuit.

Referring to the circuit of FIG. 3, the AC signal is supplied on line 12, and line 14 is connected to the neutral or return leg of the power line. A fuse 20 is placed in series with the power supply line 12 and the circuitry of the ballast so that if any of the components of the ballast fail, the fuse 20 (or circuit breaker) will blow, thus preventing excess current from flowing through the ballast circuit, which may present a fire hazard.

Assuming that the phase of the voltage source on line 12 starts up as a positive voltage, diode D1 will prevent electrolytic capacitor C8 from being charged, while diode D2 will allow electrolytic capacitor C9 to become fully charged by applying the voltage from voltage source 12 to electrolytic capacitor C9. This will load electrolytic capacitor C9 up to approximately 160 volts, which is the peak voltage supplied by a U.S. appliance outlet operating at 60 cycles and approximately 120 $volts_{rms}$.

As the cycle of the power supply connected to line 12 continues, the voltage on line 12 will become negative with respect to the neutral line connected to line 14. When this happens, diode D2 will prevent electrolytic C9 from discharging, and diode D1 will permit electrolytic capacitor C8 to charge. Electrolytic capacitor C8 will charge up to approximately 160 volts. Once electrolytic capacitor C8 is charged, the voltage across electrolytic capacitors C8 and C9 will be additive, thus applying a DC voltage across lines 22 and 24 which is equal to the combined voltage across electrolytic capacitor C9 and electrolytic capacitor C8.

Assuming that electrolytic capacitor C9 is charged to 160 volts, and electrolytic capacitor C8 is charged to 160 volts, the resulting voltage across lines 22 and 24 will be approximately 320 volts. Filter capacitor C1 helps smooth the voltage across lines 22 and 24, eliminating high frequency ripple which may otherwise appear. The particular fluorescent lamps employed in the circuit are matched with the values of capacitors C6 (and C7 if a second fluorescent lamp is connected to the circuit) and inductors L1 (and L2 if a second fluorescent lamp is employed in the circuit).

These component parts are designed integrally to optimize performance of the circuit. This will result in a high voltage start of approximately 1400 $volts_{peak}$, which would not normally be achieved through a ballast circuit with a lower DC operating voltage without a considerably higher self inductance coil in place of inductor L1 (and inductor L2 if a second fluorescent lamp is employed in the circuit configuration). Using a higher self inductance coil value results in subsequent energy loss.

During the operation of the ballast of the present invention, a higher voltage will be applied to the fluorescent lamp, which is desirable when operating the fluorescent lamp at lower ambient temperatures.

This higher voltage is needed to overcome the higher impedance of the fluorescent lamp when operating in a lower temperature environment.

The remainder of the ballast circuit of FIG. 3 operates in a manner similar to that of the prior art shown in FIG. 1. The ballast circuit operation is accomplished through use of a transformer with a winding connected in series with an output terminal and active electronic components controlling the current. The active electronic components control the current based on electrical voltages which are produced by inductive feedback through the transformer. The transformer is magnetically saturated to modify the inductive feedback relationship in such a way that the active components cyclicly change the direction of the output current, thus providing an alternating current signal at a relatively high frequency (approximately 78 kilohertz).

The magnetic saturation of the transformer is used to control the frequency of the output AC signal, resulting in diminished light at substantially higher frequencies. The electrical characteristics of the electronic switch elements, the feedback transformer, the inductive element in series with the fluorescent tube, and the capacitor in parallel with the fluorescent all play an integral role in determining the frequency of oscillation of the output. Thus, the electrical characteristics of these components, and the relationship between them, determine the light output and power consumption.

The significant difference of the present invention is the higher voltage from the voltage doubler circuit applied to the remainder of the circuit across lines 22 and 24. One would normally design the circuit as in prior art with a full wave rectifier and thereby running the remainder of the circuit on 160 VDC achievable from the 120 VAC input. By applying this higher voltage to the remainder of the circuit a way to a higher voltage for start and operation of the load is gainable with less power consumption. The DC operating voltage of the ballast of the prior art, as shown in FIG. 1, is sufficient to cause the fluorescent lamp to light at room temperature and under normal operating conditions. As the temperature of the fluorescent lamp decreases, the voltage necessary to apply across it in order to cause it to discharge properly has to be increased.

It has been observed that the characteristic impedance of a fluorescent lamp increases proportionally to the decreasing temperature of the fluorescent lamp when the fluorescent lamp is operating below temperatures of 25° C. (77° F.). At approximately 7° C., the light output of the fluorescent lamp would be considerably less than the light output of the fluorescent lamp at an ambient temperature of approximately 25° C. when being run by the ballast of the prior art as shown in FIG. 1. As the ambient temperature of the fluorescent lamp further decreases, the characteristic impedance of the fluorescent lamp increases, and the light output correspondingly decreases to a point where the fluorescent lamp will fail to light. There are several causes of this problem.

As the characteristic impedance of the fluorescent lamp increases, the operating frequency of the fluorescent lamp increases, and therefore the voltage across the electrical elements of the fluorescent lamp decreases. This causes the light output to decrease. Increasing the voltage applied to the electrical elements of the fluorescent lamp counteracts the adverse effects caused by the low temperature, and increased impedance of the fluorescent lamp. The present invention is a relatively simple way to provide this increased voltage by supplying approximately 320 volts DC to the ballast circuit as compared to the prior art in which 160 volts DC may be available with 120 volts AC input to the device.

Another problem which is solved by the present invention is the "cold start" condition. When a fluorescent lamp is mounted in a cold environment, such as a cooler or freezer, the impedance of the fluorescent lamp before it begins operating may be so high that the starter circuit is incapable of initiating the firing of the fluorescent lamp. While this condition presented itself in the starter circuit of the ballast of the prior art, the voltage doubler portion of the ballast of the present invention, working in combination with the traditional electronic circuit gains of the inductive and compacitive loads, generate a large enough voltage to get a fluorescent tube to fire at temperatures as low as −26° C. This is particularly significant because the voltage required at this temperature may be as high a 1400 $volts_{peak}$.

If there has been corrosion or other deterioration of the electrical path between the ballast and the fluorescent lamp, The decreased voltage may be insufficient to cause the lamp to light in colder ambient temperatures, or may cause the light output of the lamp to decrease below the level at which the lamp will become fully illuminated. The fluorescent lamp may be supplied with sufficient energy to become partially illuminated, but not completely illuminated, resulting in a change in the intensity of the light output.

Therefore, using the ballast of the prior art, as shown in FIG. 1, the fluorescent lamps will not light because the voltage is too low, while using the present invention, as shown in FIG. 3, the lamps will light because voltage applied across the fluorescent lamps is adapted to give better light output when applied to fluorescent lamps operating in a cold ambient environment.

There has been described hereinabove a novel ballast circuit with generally less energy consumption and higher efficiency at lower temperatures for use in powering fluorescent lamps. Those skilled in the art may now make numerous uses of and departures from the aforementioned embodiment, such as modifying the oscillator portion of the ballast, modifying the starter portion of the ballast, and modifying the energy storage, and filter portions of the ballast without departing from the inventive concepts of the invention which are defined solely by the following claims.

What is claimed is:

1. A refrigeration unit containing a fluorescent lamp and a ballast circuit for driving the fluorescent lamp, the refrigeration unit comprising:

a unit defining an enclosure and maintained at or below approximately seven degrees Centigrade;

a fluorescent lamp in the unit for lighting part of the unit;

a ballast circuit provided in association with the unit for supplying current to the lamp;

an input terminal for the ballast circuit for receiving an input voltage;

an output terminal for the ballast circuit and coupled to the lamp for delivering an output current to the fluorescent lamp;

a voltage doubler circuit connected to the input terminal and supplying voltage to the remainder of the ballast circuit;

an inductance device connected in series with said output terminal, said inductance device including saturable magnetic material and feedback windings around the magnetic material;

a plurality of switch elements between the input terminal and the inductance device controlled by electric voltages induced in the feedback windings through magnetization of the saturable magnetic material and wherein the switch elements include activation means coupled to the feedback windings; and a start network connected to at least one of said activation means.

2. The unit of claim 1 in which said starter network comprises a current source supplying current to said output terminal before providing a start signal.

3. The unit of claim 1 wherein the inductance device includes a transformer having a power winding, and two feedback windings, the power winding coupled to the output terminal for carrying current to the lamp.

4. The unit of claim 3 wherein the start unit is coupled to one of the feedback windings.

5. The unit of claim 1 in which said voltage doubler converts alternating current to direct current of a voltage greater than 150% of said input voltage when measured RMS.

6. The unit of claim 1 wherein the ballast circuit includes means for providing an alternating current signal at the output at a frequency and voltage different from the voltage and frequency at the input and wherein the start network supplies a current to the output before the alternating current at the second frequency is delivered to the output.

7. The unit of claim 1 wherein the fluorescent lamp has dual filaments.

8. The unit of claim 1 wherein the ballast circuit is configured to provide an alternating current signal to operate at a frequency greater than the frequency of the alternating current signal input to the ballast.

9. The unit of claim 8 wherein the frequency of the ballast circuit is approximately 78 kiloHertz.

10. The unit of claim 1 wherein the ballast circuit is configured to operate to produce a voltage to the lamp of approximately 1400 volts peak.

11. The unit of claim 10 wherein the ballast circuit includes only one voltage doubler circuit.

12. A method for starting the lighting and maintaining the lighting of a fluorescent lamp in a refrigeration unit containing a ballast circuit for driving the fluorescent lamp, the method comprising the steps of:

assembling a unit defining an enclosure configured to be maintained at or below approximately seven degrees Centigrade;

installing a fluorescent lamp in the unit for lighting part of the unit;

installing a ballast circuit in association with the unit and coupling the ballast circuit to the lamp for supplying current to the lamp, wherein the ballast circuit includes:

an input terminal for the ballast circuit for receiving an input voltage, an output terminal for the ballast circuit and coupled to the lamp for delivering an output current to the fluorescent lamp, a voltage doubler circuit connected to the input terminal and supplying voltage to the remainder of the ballast circuit, an inductance device connected in series with said output terminal, said inductance device including saturable magnetic material and feedback windings around the magnetic material, a plurality of switch elements between the input terminal and the inductance device controlled by electric voltages induced in the feedback windings through magnetization of the saturable magnetic material and wherein the switch elements include activation means coupled to the feedback windings, and a start network connected to at least one of said activation means; and connecting an external power supply to the input of the ballast circuit and turning on the power to the ballast and therefore to the lamp so as to light and to maintain lighted the lamp when the interior of the refrigeration unit is at or below approximately seven degrees Centigrade.

* * * * *